US005994656A

United States Patent [19]

Satake et al.

[11] Patent Number: 5,994,656

[45] Date of Patent: Nov. 30, 1999

[54] COLOR SORTING MACHINE FOR CEREAL GRAIN OR THE LIKE HAVING DUST COLLECTING DEVICE

[75] Inventors: Satoru Satake, Tokyo; Takafumi Ito, Mihara; Hiroshi Tanimoto, Hiroshima, all of Japan

[73] Assignee: Satake Corporation, Tokyo, Japan

[21] Appl. No.: 08/985,954

[22] Filed: Dec. 5, 1997

[30] Foreign Application Priority Data

Dec. 16, 1996 [JP] Japan ..... 8-353518

[51] Int. Cl.[6] ..... B07C 5/342; A47L 9/10

[52] U.S. Cl. ..... 209/580; 209/643; 209/938; 15/347

[58] Field of Search ..... 209/577, 580, 209/587, 639, 644, 932, 938, 643; 15/347

[56] References Cited

U.S. PATENT DOCUMENTS

| | | | |
|---|---|---|---|
| 4,042,114 | 8/1977 | Arlid et al. | 209/587 |
| 4,371,081 | 2/1983 | Satake | 209/580 |
| 4,513,868 | 4/1985 | Culling | 209/581 |
| 4,699,273 | 10/1987 | Suffi-Liverani | 209/580 |
| 4,940,850 | 7/1990 | Satake | 209/580 |
| 5,487,472 | 1/1996 | Satake | 209/581 |
| 5,638,961 | 6/1997 | Satake | 209/580 |
| 5,713,473 | 2/1998 | Satake et al. | 209/580 |

FOREIGN PATENT DOCUMENTS

| | | |
|---|---|---|
| 0 044 014 | 1/1982 | European Pat. Off. . |
| 0 045 576 | 2/1982 | European Pat. Off. . |
| 0 734 789 | 10/1996 | European Pat. Off. . |
| 42 00 226 | 7/1993 | Germany . |
| 55-159881 | 12/1980 | Japan . |
| 56-10379 | 2/1981 | Japan . |
| 57-65367 | 4/1982 | Japan . |
| 61-21775 | 1/1986 | Japan . |
| 3-89980 | 4/1991 | Japan . |

OTHER PUBLICATIONS

International Search Report for corresponding application No. EP 97 12 1776.

*Primary Examiner*—Tuan N. Nguyen
*Attorney, Agent, or Firm*—Darby & Darby

[57] ABSTRACT

A color sorting machine sorts particles of different colors from raw material such as cereal grains or the like. The machine has a down chute descending towards a front side of the machine for letting raw material particles flow down linearly, a photoelectric detection device which subjects the raw material particles jumped out of the down chute to light and discriminates different-color particles in accordance with difference in reflected light, and a nozzle device which injects air to and blows off the different-color particles. The injection nozzle device is situated on the rear side of the machine with respect to a coming-down locus of raw material particles from the down chute and close to the coming-down locus. The sorting machine further comprises a dust collecting device which is situated on the front side of the machine with respect to the coming-down locus of the raw material. The dust collecting device has a dust collection opening which is substantially opposite to the injection nozzle device with the coming-down locus interposed therebetween, sucks in and discharges dust scattered from the raw material. The color sorting machine is highly precise in sorting different-color particles and facilitates cleaning of the dust collecting device.

4 Claims, 3 Drawing Sheets

COLOR SORTING MACHINE FOR CEREAL GRAIN OR THE LIKE HAVING DUST COLLECTING DEVICE

BACKGROUND OF THE INVENTION

The present invention relates to a color sorting machine for cereal grain or the like and, more particularly, to a color sorting machine provided with a dust collecting device.

A conventional sorting machine of this type is adapted to let raw material, such as cereal grains, fall down linearly, subject the raw material to light and sort out particles of different colors, such as deteriorated or broken grains and foreign matters from the raw material in accordance with a difference in reflected light. For this purpose, the sorting machine has a down chute descending toward a front side of the machine for letting the raw material slide or flow down, a photoelectric detection device which comprises light sources, light-receiving elements and backgrounds, and an injection nozzle device. The photoelectric detection device generates an electric signal upon detection of a different-color particle, and in response to this detection signal, the injection nozzle device is operated to sort the different-color particle.

Such a sorting machine can be seen in U.S. Pat. Nos. 4,371,081, 4,940,850, 5,487,472 and 5,638,961, all of which are of the same assignee as the present invention, and in U.S. Pat. Nos. 4,513,868 and 4,699,273.

Also known is a color sorting machine of the type having a dust collecting device in addition to the components described above. Such a sorting machine is disclosed in Japanese Patent Application Laid-Open Nos. Sho 55-159881, 56-10379, 57-65367 and 61-21775, which are all of the same assignee as the present invention, and in Japanese Patent Application Laid-Open No. Hei 3-89980 and.

An example of the color sorting machine provided with the dust collecting machine is shown in FIG. 3. In the sorting machine, an injection nozzle device 400 injects air to raw material so as to sort particles of different colors. At this time, dust is scattered from the raw material and floats in the machine. When the floating dust sticks to light sources 200*a*, light-receiving elements 200*b* and transparent plates 200*c* for covering these components in a photoelectric detection device 200, light emitted from the light sources 200*a* is attenuated, and therefore, the detection sensitivity of the light-receiving elements 200*b* becomes low. As a result, the photoelectric detection device 200 causes a wrong operation in its detection, thereby deteriorating the sorting performance.

The dust collecting device 500 continuously sucks the dust in suspension in the machine by means of a fan 500*b* to prevent the performance of the photoelectric detection device 200 from being deteriorated. The dust collecting device 500 is disposed on the bottom 600*a* side of a tilted down chute 600. Therefore, cleaning of the dust collecting device 500 is carried out on the rear side of the machine. In the case where the sorting machine is installed with its back against a wall or the like, the machine itself has to be moved to provide a work space for every cleaning of the dust collecting device. Cleaning of such a dust collecting device is thus troublesome.

On the other hand, the injection nozzle device 400 is situated on the open or flow passage side of the down chute 600, that is, with a nozzle 400*a* directed from the right side of the down chute 600 to a locus a of coming down of the raw material particles in FIG. 3. Meanwhile, the raw material particles frequently slide down the down chute 600 in plural layers. In this case, particles in the first layer flow down linearly along the bottom 600*a* of the down chute 600. The second and subsequent layers of particles are not guided by the bottom 600*a*, and there are cases where they deviate toward the open side of the down chute and disturb the flow. When the thus scattering particles are out of the coming-down locus a and hit the nozzle 400*a* or its vicinity, they are judged as being different-color particles, even if they are whole grains or particles of good quality. Therefore, the injection nozzle device 400 and the coming-down locus a have to be separated at a certain distance from each other, so that the upper layers of particles do not contact the nozzle 400*a* and its vicinity. On the contrary, if the distance between the injection nozzle device 400 and the coming-down locus a is too large, the flow of injected air is excessively enlarged or expanded. This results in that not only particles to be discharged but also surrounding particles are removed. The sorting precision is thus deteriorated.

SUMMARY OF THE INVENTION

The present invention has an object of solving the above problems and providing a color sorting machine for cereal grain or the like which is highly precise in sorting particles of different colors.

It is another object of the invention to provide a color sorting machine in which cleaning of a dust collecting device can be made easily.

To attain these objects, the color sorting machine for sorting particles of different colors from raw material such as cereal grain or the like according to the invention comprises a down chute which is inclined and has an open upper side for letting raw material particles flow down, a photoelectric detection device provided adjacent a flowing-down or coming-down locus of the raw material particles jumped out of the down chute, which photoelectric detection device subjects the raw material to light and discriminates particles of different colors, an injection nozzle device provided adjacent the coming-down locus of the raw material particles, which injection nozzle device injects air to and blows off the particles of different colors, a control device which is connected to the photoelectric detection device and the injection nozzle device and operates the injection nozzle device in response to an output of the photoelectric detection device, and a dust collecting device sucking in and discharging dust which is scattered from the raw material and floats in the machine. The sorting machine is characterized in that the injection nozzle device is disposed on a bottom side of the down chute with respect to the coming-down locus of the raw material particles and close thereto, and that the dust collecting device is disposed on the open side of the down chute with respect to the coming-down locus and has a dust collection opening which is substantially opposite to the injection nozzle device with the coming-down locus interposed therebetween.

With the above arrangement, as the injection nozzle device is disposed on the bottom side of the down chute with respect to the coming-down locus of raw material particles, it is seldom that the raw material particles hit the nozzle device, deviate from the coming-down locus and is treated as particles of different colors. Therefore, the injection nozzle device can be situated close to the coming-down locus of the raw material particles to blow off objective or target particles, and no surrounding whole grains are removed together by involvement. Also, the dust collecting device is disposed on the open side of the down chute with respect to the coming-down locus, has the dust collection opening which is substantially opposed to the injection nozzle device with the coming-down locus interposed between them, sucks in and discharges the dust scattered by jet air from the nozzle device. Therefore, the floating dust is less, and there is a little possibility that the floating dust sticks to the photoelectric detection device and causes an erroneous optical detection operation. The sorting precision of different-color particles of this sorting machine is thus high. Further, as described above, the distance between the injection nozzle device and the coming-down locus of raw material particles is short, only a small quantity of jet air is necessary for sorting different-color particles, and an air consumption can be reduced.

The dust collection opening of the dust collecting device is preferably formed in a dust collecting box rotatably mounted on the machine, so that the dust collection opening can be exposed outside the machine. At the time of cleaning, the dust collecting box is rotated to expose the dust collection opening to the outside of the machine. In this condition, the dust collection opening is easy of access and can be cleaned readily not to cause clogging or the like with dust.

Furthermore, it is preferable to define the dust collection opening of the dust collecting device by an air-permeable member for passing only dust and to detachably mount the air-permeable member to the dust collecting box. When cleaning the dust collecting device, the dust collection opening can be removed to be cleaned more thoroughly.

The color sorting machine preferably further comprises a partition plate for separating the photoelectric detection device and the injection nozzle device from each other, which partition plate is of an air-permeable structure for passing only dust. The partition plate serves to prevent light of the photoelectric detection device from dispersing and thereby improve the detection operation. In this case, the floating dust around the photoelectric detection device passes through the partition plate of air-permeable structure and is discharged by the dust collecting device. Accordingly, erroneous operation of the photoelectric detection device is further reduced and the sorting precision is enhanced.

BRIEF DESCRIPTION OF THE DRAWINGS

The above and other objects and features of the invention will be more apparent from the description which will be made later with reference to accompanying drawings, in which.

DESCRIPTION OF PREFERRED EMBODIMENT

Figure 1:
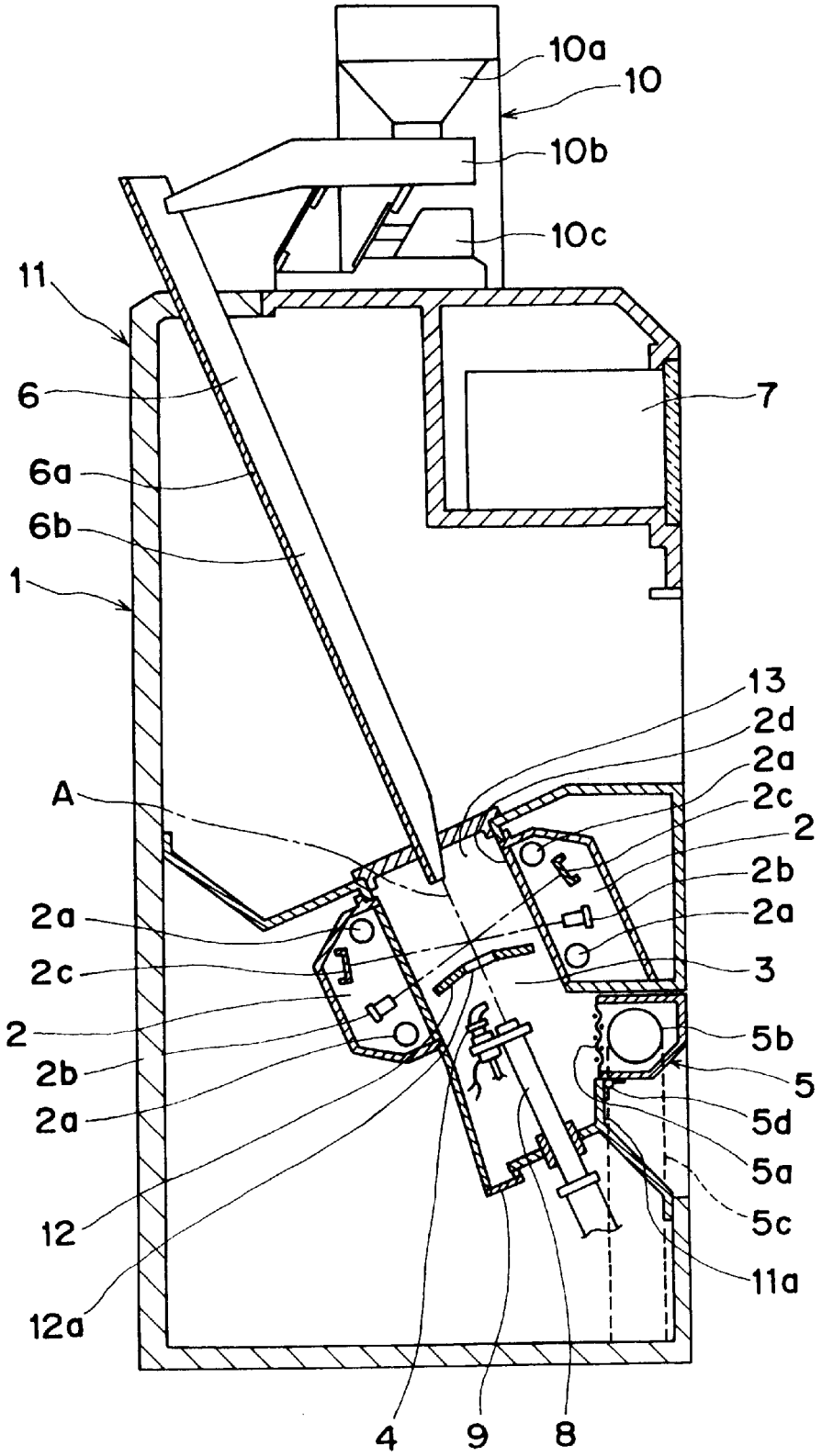
FIG. 1 is a sectional side view of the color sorting machine according to an embodiment of the invention.
Figure 2:
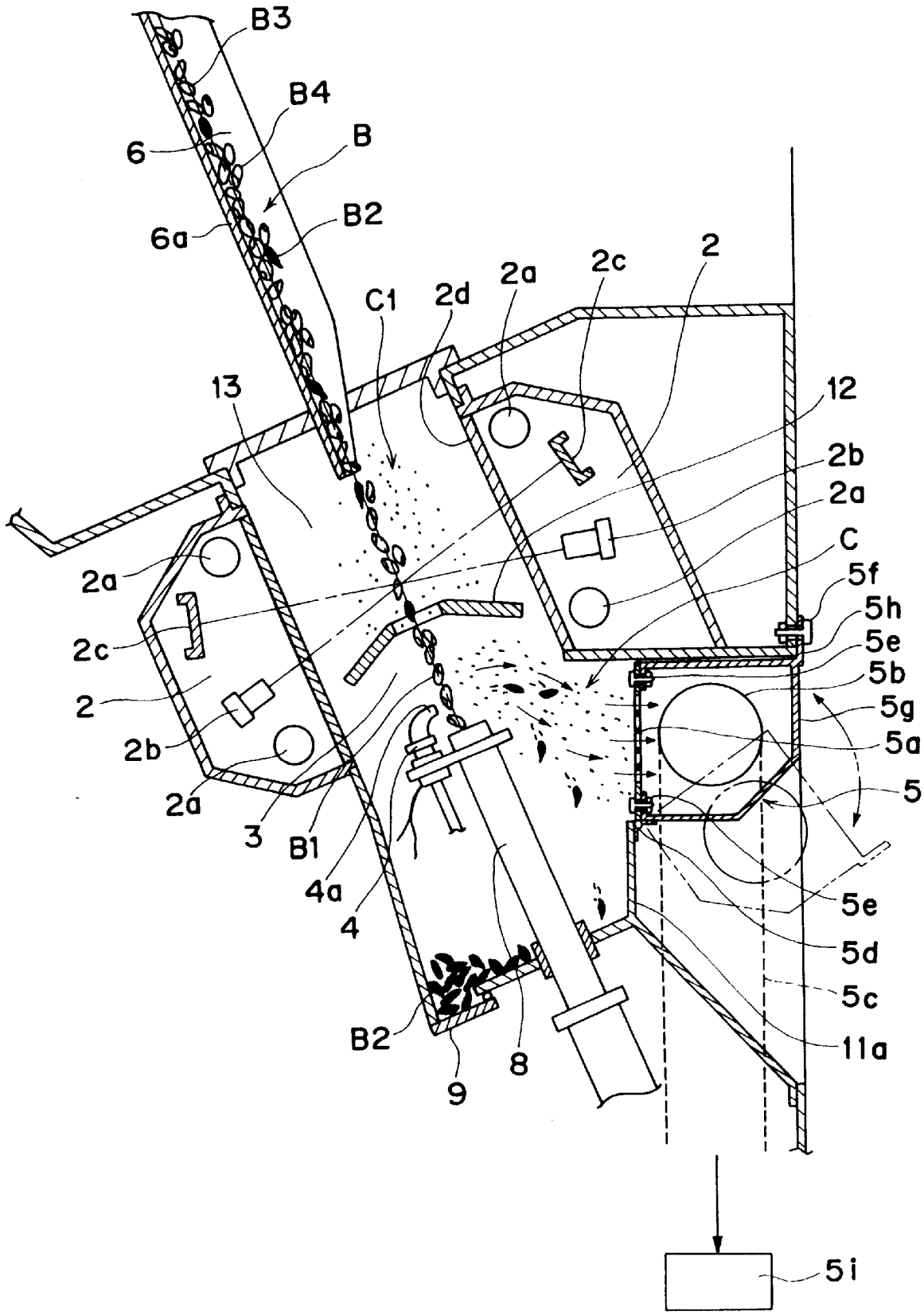
FIG. 2 is an enlarged view of an essential part of the machine of FIG. 1.
Figure 3:
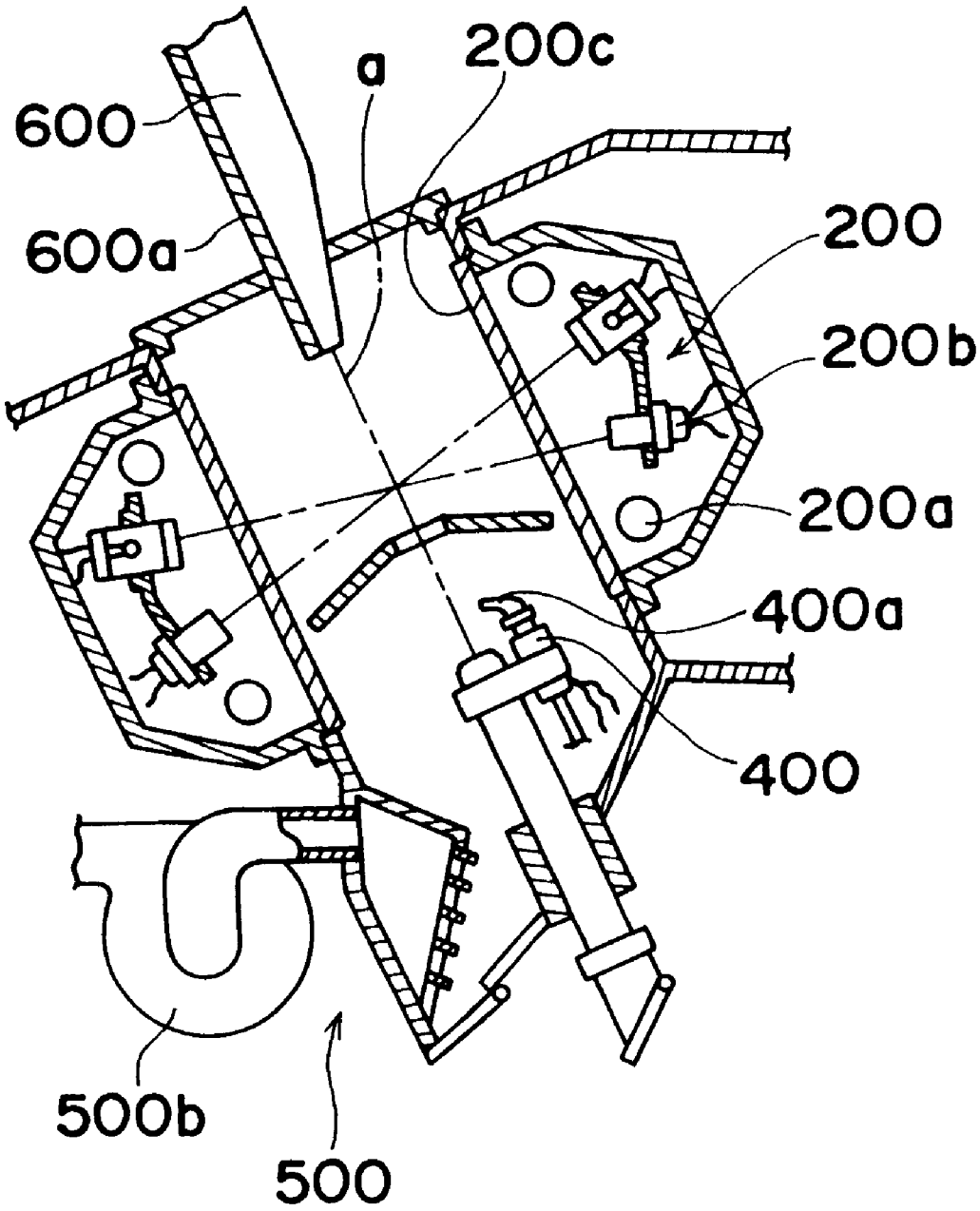
FIG. 3 PRIOR ART
FIG. 3 is a sectional view showing an essential part of a conventional color sorting machine.

With reference to FIGS. 1 and 2, the cereal grain color sorting machine according to an embodiment of the invention will be described below.

The sorting machine 1 has, on the top of a vertical frame 11, a device 10 for supplying raw material of cereal grains. The supply device 10 is constituted of a supply hopper 10*a*, a vibration feeding chute 10*b* and a vibrating unit 10*c*. The chute 10*b* is connected at its discharge side to the upper end of a down chute 6. The chute 6 is mounted to incline from the rear side of the frame 11 obliquely toward the front side and forms a tilted channel which is open at its upper face 6*b*. The lower end of the chute 6 passes through the upper wall of an optical detection chamber 13 in a lower portion of the machine frame.

The optical detection chamber 13 is defined by a photoelectric detection device, or a pair of photoelectric detection portions 2 which are provided opposite to each other. The photoelectric detection portions 2 are disposed, with a coming-down locus A of raw material particles from the down chute 6 interposed between them, on the side of a bottom 6*a* of the chute 6 and the upper open face 6*b* side thereof, respectively. Each photoelectric detection portion 2 is comprised of light sources 2*a*, a light-receiving element 2*b*, a background 2*c* and a transparent plate 2*d* for covering the components.

Beneath the photoelectric detection chamber 13, a sorting portion 3 is provided. The sorting portion 3 is constituted of an injection nozzle device 4 and a cereal collecting cylinder 8. The cylinder 8 is disposed along the coming-down locus A of raw material particles for accommodating whole particles or cereal grains of good-quality. The device 4 is situated on the bottom 6*a* side of the down chute 6 or on the rear side of the sorting machine 1 with respect to the coming-down locus A, more specifically, it is on the left of the locus A in the figures with its nozzle opening directed to the particle locus A.

A partition plate 12 is provided between the optical detection chamber 13 and the sorting portion 3, which partition plate 12 has a through hole 12*a* for passage of raw material particles B. The partition plate 12 prevents light of the light sources from dispersing outside the optical detection chamber 13. Provided in an upper portion of the frame 11 is a control device 7 which is connected to the light-receiving elements 2*b* of the photoelectric detection portions 2 and the injection nozzle device 4 of the sorting portion 3.

The sorting machine 1 further comprises a dust collecting device 5 in a lower portion of the frame 11. The device, except a ventilating fan provided outside the frame 11, is mounted adjacent to the sorting portion 3 on the front side of the frame 11. This means that a major or main part of the dust collecting device 5 is on the upper face 6*b* side of the down chute 6 with respect to the coming-down locus A, i.e. on the right of the locus A in the figures. A dust collection opening of the device 5 is positioned at substantially the same height with a nozzle 4*a* of the injection nozzle device 4 or slightly below the nozzle so that it is substantially opposite to the nozzle 4*a* with the coming-down locus A interposed therebetween.

The "front side" referred to herein means the side of the sorting machine which comes to be front in a usual installation condition, and "rear face" means its opposite side.

The dust collecting device 5 comprises a dust collecting box 5*g* and the ventilating fan 5*i* connected to the box. The box 5*g* has a dust collection opening or window 5*a*, and a vent opening 5*b* is formed in a side of the box. The dust collection window 5*a* is formed of a perforated or punched metal, and has air-permeability to such a degree that different-color particles B2 mixed in the cereal grains are not passed. However, as far as this requirement is satisfied, the dust collection window 5*a* may be formed of another material, for example, a wire mesh. A dust collecting duct 5*c* extends from the vent opening 5*b* to the ventilating fan 5*i* outside the machine frame to connect the dust collecting box 5*g* and the ventilating fan 5*i*.

The dust collection window 5*a* is detachably mounted on the dust collecting box 5*g* with fixing members 5*e* such as bolts and nuts. The dust collecting box 5*g* is attached at its lower edge to the frame 11 through a rotary member 5*d*, so that the dust collecting box 5*g* can be rotated to the outside. An upper end of the dust collecting box 5*g* is fixed with a fixing piece 5*h* and fixing members 5*f* to the frame 11.

Operation of the color sorting machine constructed as above will be now described.

The raw material of cereal grains, when thrown into the supply hopper 10*a*, fall down through this hopper onto the feeding chute 10*b*. The raw material particles are transferred to the discharge side of the chute 10*b*, through vibration of the vibrating device 10*c*, and fed to the down chute 6 at a substantially constant flow rate. The raw material particles B then slide down along the inclined down chute 6 while accelerating and pass in a flying manner through the optical detection chamber 13 along the coming-down locus A.

At this time, in the respective photoelectric detection portions 2, the light sources 2*a* radiate light to the raw material particles B and the backgrounds 2*c*. The light-receiving elements 2*b* detect the quantity of light reflected from and/or transmitted through the raw material particles B and the quantity of light from the backgrounds 2*c*, and send the detected data to the control device 7.

The control device 7 compares a difference between detected values with a reference light quantity stored therein beforehand. If the difference in the detected values deviates from the reference value, the control device 7 judges that the detected is a different-color particle B2 and generates an electric signal to operate the injection nozzle device 4. The nozzle device 4 jets high-pressure air to the different-color particle B2 to discharge it outside the coming-down locus A. In this manner, particles of different colors B2 are deviated from the cereal collecting cylinder 8 to fall down on a discharge valve 9 below the sorting portion 3. The different-color particles B2 collected on the discharge valve 9, when amounting to a predetermined volume, force the discharge valve 9 open due to their weight to fall down. On the other hand, whole grains B1 flowing down along the locus A enter the cereal collecting cylinder 8. The thus sorted whole grains B1 and different-color particles B2 are taken outside the machine, thereby finishing the sorting operation.

The construction and operation of the photoelectric detection portions 2 and the control device may be the same as the conventional art described above, and further description is omitted.

During the above operation, the air jetted from the injection nozzle device 4 which is directed to the coming-down locus A causes dust C to scatter from the raw material particles toward the front side of the machine. The dust C enters the window 5*a* of the dust collecting device 5, which is opposed to the injection nozzle device 4, and is drawn and discharged outside the frame 11 by the ventilating fan 5*i* of the same device through the vent opening 5*b* and the dust collecting duct 5*c*. In this manner, the duct collecting device 5 sucks the dust C immediately without allowing the dust to float in the sorting portion 3 and enter the optical detection chamber 13.

Cleaning of the dust collecting device 5 is carried out as follows. First, the fixing members 5*f* are detached from the fixing piece 5*h* of the dust collecting box 5*g*. The dust collecting box 5*g* can be rotated around the rotary member 5*d* to the outside of the frame 11 to be accommodated in a clearance portion 11*a* which is formed in a recessed manner in the front face of the frame 11. The window 5*a* of the dust collecting box 5*g* is thus exposed to the outside of the frame 11, so that a surface of the window 5*a* can be cleaned. Further, by detaching the fixing members 5*e*, the dust collecting window 5*a* may be removed to be cleaned more conscientiously, and the inside of the dust collecting box 5*g* may also be cleaned.

The arrangement of the injection nozzle device 4 according to the invention will be described. The nozzle device 4 is provided on the bottom 6*a* side of the down chute 6 and directed to the coming-down locus A. Therefore, even if the raw material particles B, when sliding down along the down chute 6, form plural layers B3 and B4, and if the upper layer particles B4 disturb the flow toward the open side of the chute 6, they never contact the injection nozzle device 4. Accordingly, the nozzle 4*a* of the injection nozzle device 4 can be close to the coming-down locus A. The injection nozzle device 4 thus arranged injects air from near to different-color particles B2 to securely sort out only the objective particles.

Incidentally, in the embodiment, the partition plate 12, which separates the optical detection chamber 13 and the sorting portion 3 from each other, is also formed of a punched metal and has air-permeability. While the raw material particles B slide down the inclined down chute 6, dust C1 is generated to float in the optical detection chamber 13, but the dust C1 is also sucked in the dust collecting device 5 through the partition plate 12.

Although the invention has been described with reference to the embodiment, the invention is not limited solely to the specific form. The form described may be modified variously without deviating from the scope of accompanying claims, and the invention may be embodied in other forms.

What is claimed is:

1. A color sorting machine for sorting particles of different colors from raw material comprising: a down chute inclined and having an open upper side for letting raw material particles flow down; a photoelectric detection device provided adjacent a coming-down locus of the raw material particles flying out of said down chute, said photoelectric detection device subjecting the raw material to light and discriminating particles of different colors; an injection nozzle device provided adjacent the coming-down locus of the raw material particles, said injection nozzle device injecting air to and blowing off the particles of different colors; a control device connected to said photoelectric detection device and said injection nozzle device and operating said injection nozzle device in response to an output of said photoelectric detection device; and a dust collecting device sucking in and discharging dust scattered from the raw material and floating in the machine, wherein said injection nozzle device is disposed on a bottom side of said down chute with respect to the coming-down locus of the raw material particles and close thereto, and said dust collecting device is disposed on the open upper side of said down cute with respect to the coming-down locus and has a dust collection opening which is substantially opposite to said injection nozzle device with the coming-down locus interposed therebetween.

2. The color sorting machine according to claim 1, wherein said dust collection opening of said dust collecting device is formed in a dust collecting box which is mounted rotatably on the machine so that the dust collection opening can be exposed outside of the machine.

3. The color sorting machine according to claim 2, wherein said dust collection opening of said dust collecting device is defined by an air-permeable member which passes only dust, and said air-permeable member is detachably attached to said dust collecting box.

4. The color sorting machine according to claim 1 further comprising a partition plate for separating said photoelectric detection device from said injection nozzle device, said partition plate having an air-permeable structure for passing only dust.

* * * * *